US007175259B2

(12) United States Patent
Aoshima

(10) Patent No.: US 7,175,259 B2
(45) Date of Patent: Feb. 13, 2007

(54) INKJET RECORDING METHOD

(75) Inventor: Keitaro Aoshima, Shizuoka (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 111 days.

(21) Appl. No.: 11/019,159

(22) Filed: Dec. 23, 2004

(65) Prior Publication Data

US 2005/0151821 A1 Jul. 14, 2005

(30) Foreign Application Priority Data

Dec. 26, 2003 (JP) ..... P2003-433920
Dec. 26, 2003 (JP) ..... P2003-434233

(51) Int. Cl.
*B41J 2/06* (2006.01)

(52) U.S. Cl. ..... 347/55

(58) Field of Classification Search ..... 347/54, 347/55

See application file for complete search history.

(56) References Cited

U.S. PATENT DOCUMENTS 5,952,048 A 9/1999 Tsubuko et al.
6,158,844 A 12/2000 Murakami et al.
6,470,799 B2 * 10/2002 Nakazawa et al. ..... 101/466

FOREIGN PATENT DOCUMENTS

JP 8-291267 A 11/1996
JP 3315334 B2 6/2002

* cited by examiner

*Primary Examiner*—Huan Tran
(74) *Attorney, Agent, or Firm*—Sughrue Mion, PLLC

(57) ABSTRACT

An inkjet recording method comprising ejecting an ink composition comprising a dispersion medium and charged particles containing at least a colorant by utilizing an electrostatic field, wherein the method comprises preparing as the ink composition, an initial feeding ink composition and a replenishing ink composition in which solid content concentration is controlled higher than solid content concentration of the initial feeding ink composition, and replenishing the replenishing ink composition in order to compensate decrease in concentration of the charged particles due to ejection of the initial feeding ink composition.

4 Claims, 3 Drawing Sheets

INKJET RECORDING METHOD

FIELD OF THE INVENTION

The present invention relates to an inkjet recording method.

BACKGROUND OF THE INVENTION

As an image recording method of forming an image on a recording medium, for example, paper, based on image data signals, there are an electrophotographic system, a sublimation or melting thermal transfer system and an inkjet system. The electrophotographic system is a complex system and an apparatus therefor is expensive because it requires such a process that an electrostatic latent image is formed on a photoreceptor drum through charge and exposure. The thermal transfer system involves a high running cost and generation of waste materials due to the use of an ink ribbon, although an apparatus therefor itself is inexpensive. In the inkjet system, on the other hand, image formation is carried out with an inexpensive apparatus in such a manner that an ink is directly ejected to only a necessary image area on a recording medium, and thus the ink can be used efficiently to reduce the running cost. Further, the inkjet system causes less noise, and thus it is excellent as the image recording method.

The inkjet recording system includes, for example, a system of flying ink droplets by pressure of vapor generated by heat from a heat generator, a system of flying ink droplets by mechanical pressure pulses generated by a piezoelectric element, and a system of flying ink droplets containing charged particles by utilizing an electrostatic field (refer to Patent Document 1 and Patent Document 2). The system of flying ink droplets with vapor or mechanical pressure cannot control a flying direction of ink droplet, and there are some cases where ink droplet is difficult to be accurately reached to the desired position on a printing medium due to distortion of ink nozzle and air convection.

On the contrary, the system utilizing an electrostatic field controls the flying direction of ink droplet with the electrostatic field to enable ink droplet to be accurately reached the desired position, and thus it is advantageous in that an imaged material (printed material) with high image quality can be produced.

As an ink composition for use in the inkjet recording system utilizing an electrostatic field, an ink composition comprising a dispersion medium and charged particles containing at least a colorant is ordinarily employed (refer to Patent Document 3 and Patent Document 4). The ink composition containing a colorant can form inks of four colors, i.e., yellow, magenta, cyan and black, by changing the colorant, and can also form special color inks of gold and silver. Accordingly, the ink composition is useful for producing a color imaged material (printed material). Heretofore, however, it is difficult to eject ink droplets constantly and stably in the inkjet recording for a long period of time.

Patent Document 1: U.S. Pat. No. 6,158,844

Patent Document 2: U.S. Pat. No. 3,315,334

Patent Document 3: U.S. Pat. No. 5,952,048

Patent Document 4: JP-A-8-291267 (the term "JP-A" as used herein means an "unexamined published Japanese patent application")

In the inkjet recording system in which charged particles are ejected utilizing an electrostatic field, in general, since the charged particles is concentrated and ejected by electrostatic force, concentration of the charged particles after the ejection is reduced in comparison with concentration of the charged particles in the ink composition before the ejection. Accordingly, when only an ink composition initially fed (initial feeding ink composition) has been continuously used, the concentration of the charged particles decreases and as a result, electric conductivity of the ink composition necessary for the ejection decreases to cause a problem in that the ejection of ink cannot be conducted. Also, in the case wherein concentration of charged particles in the initial feeding ink composition is same as concentration of the charged particles in a replenishing ink composition, the reduction in the concentration of charged particles due to the concentration and ejection is unable to compensate and consequently a problem arises in that density of the image formed is reduced.

Further, in the inkjet recording system in which charged particles are ejected utilizing an electrostatic field, as a charge amount of the charged particle increases, stronger electrostatic forth acts on the particle so that the particle is preferentially ejected. Also, since the generation of charge on particle is caused by adsorption of a charge controlling agent on the surface of particle, as the surface area of particle increases, the charge amount increases. Specifically, as a diameter of the particle increases, the charge amount increases. Accordingly, as the diameter of the particle increases, stronger electrostatic forth acts on the particle so that the particle is preferentially ejected. In fact, however, the diameter of the charged particle in the ink composition is not simple but has distribution. Since the particles having a large diameter are preferentially ejected as described above, the particles having a small diameter are not ejected and accumulated in the ink composition during a large amount of inkjet recording and as a result, a problem occurs in that an average particle diameter of the ink composition decreases. Moreover, since the electrostatic forth acts on the particles having a small diameter is weak, they cause problems in that response to pulse frequency for driving the ejection decreases and in that density of the image formed is reduced.

SUMMARY OF THE INVENTION

An object of the present invention is to provide an inkjet recording method to eject ink droplets constantly and stably in the inkjet recording for a long period of time.

Another object of the invention is to provide an inkjet recording method enabling formation of high quality image for a long period of time.

As a result of intensive investigations to achieve the above-described objects, the inventor has found that by using a replenishing ink composition in addition to an initial feeding ink composition, charged particles consumed by the ejection can be compensated to enable the ejection even when continuously used and that by controlling concentration of charged particle in the replenishing ink composition higher than concentration of charged particle in the initial feeding ink composition, the reduction in the concentration of charged particles due to the concentration is compensated so that the reduction of image density can be prevented. That is, it has been found that the above-described objects can be achieved by compensating the reduction in the concentration of charged particles in the ink composition after the ejection with the specific replenishing ink composition to complete the invention.

Also, the inventor has focused attention on that by controlling an average particle diameter of the charged particles in the replenishing ink composition larger than an average particle diameter of the charged particles in the initial feeding ink composition, the decrease in an average particle diameter of the ink composition accompanied with a large amount of the ejection can be compensated to prevent the degradation of ejection property and found that the above-described objects can be achieved by compensating the reduction in the concentration of the charged particles in the ink composition after the ejection with the specific replenishing ink composition to complete the invention.

Specifically, the present invention includes the following items.

(1) An inkjet recording method comprising ejecting an ink composition comprising a dispersion medium and charged particles containing at least a colorant by utilizing an electrostatic field, wherein the method comprises preparing as the ink composition, an initial feeding ink composition and a replenishing ink composition in which solid content concentration is controlled higher than solid content concentration of the initial feeding ink composition, and replenishing the replenishing ink composition in order to compensate decrease in concentration of the charged particles due to ejection of the initial feeding ink composition.

(2) An inkjet recording method comprising ejecting an ink composition comprising a dispersion medium and charged particles containing at least a colorant by utilizing an electrostatic field, wherein the method comprises preparing as the ink composition, an initial feeding ink composition and a replenishing ink composition in which a volume average particle diameter of the charged particles is controlled larger than a volume average particle diameter of the charged particles in the initial feeding ink composition, and replenishing the replenishing ink composition in order to compensate decrease in concentration of the charged particles due to ejection of the initial feeding ink composition.

Figure 1:
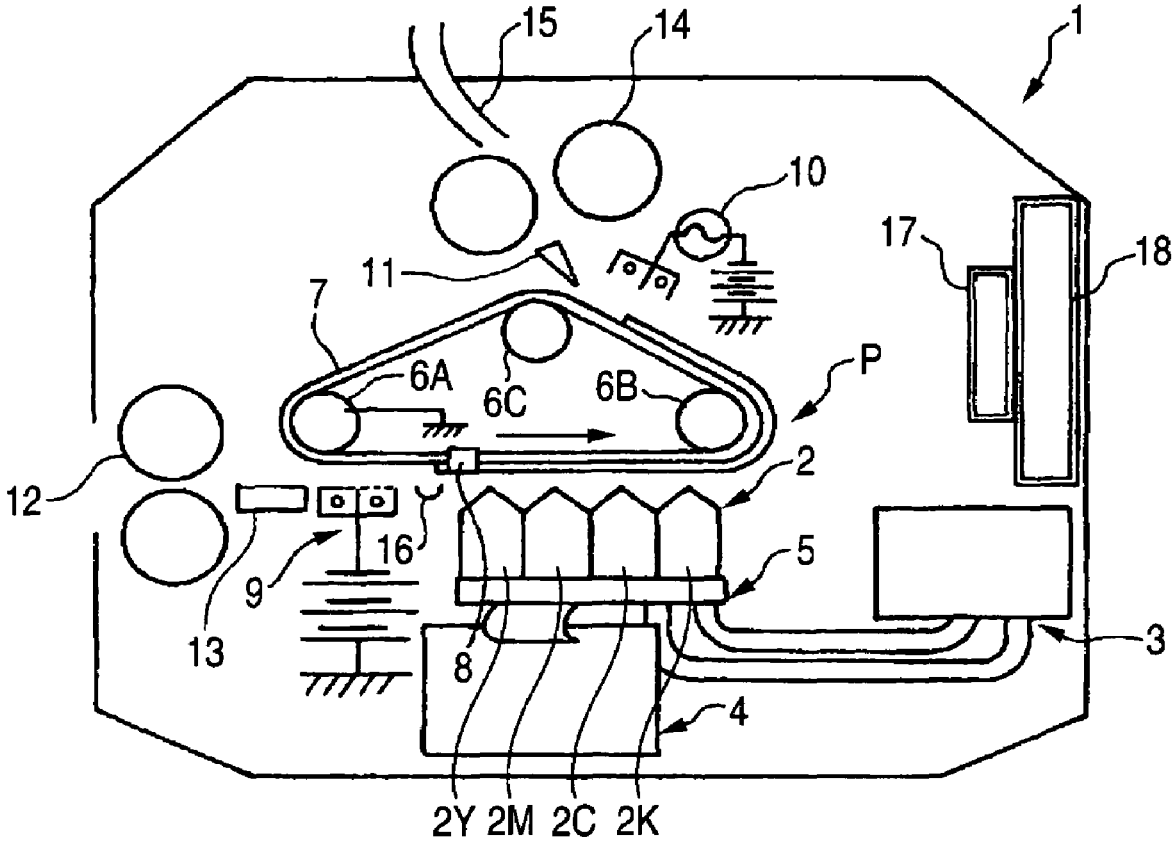
FIG. 1 is an overall construction view schematically showing an example of an inkjet recording apparatus used in the invention.

G: Ink droplet
P: Recording medium
Q: Ink flow
R: Charged particle
1: Inkjet recording apparatus
2, 2Y, 2M, 2C, 2K: Ejection head
3: Ink circulation system
4: Head driver
5: Position controlling means
6A, 6B, 6C: Roller
7: Conveying belt
8: Conveying belt position detecting means
9: Electrostatic adsorption means
10: Static eliminating means
11: Mechanical means
12: Feed roller
13: Guide
14: Image fixing means
15: Guide
16: Recording medium position detecting means
17: Exhaust fan
18: Solvent vapor absorbent
38: Ink guide
40: Supporting bar
42: Ink meniscus
44: Insulating layer
46: First ejection electrode
48: Insulating layer
50: Guard electrode
52: Insulating layer
56: Second ejection electrode
58: Insulating layer
62: Floating electroconductive plate
64: Coating film
66: Insulating member
70: Inkjet head
72: Ink flow channel
74: Substrate
75, 75A, 75B: Opening
76, 76A, 76B: Ejection part
78: Ink guide part

DETAILED DESCRIPTION OF THE INVENTION

According to the invention, an inkjet recording method capable of ejecting ink droplets constantly and stably in the inkjet recording for a long period of time and enabling formation of high quality image for a long period of time.

The ink composition for use in the invention will be described in detail below.

The ink composition for use in the invention contains a dispersion medium and charge particles containing at least a colorant.

Dispersion Medium

The dispersion medium is preferably a dielectric liquid having a high electric resistance, specifically $10^{10}$ Ωcm or more. A dispersion medium having a low electric resistance is not suitable for the invention since such a dispersion medium causes electric conduction between recording electrodes adjacent to each other. The dielectric liquid preferably has a specific dielectric constant of 5 or less, more preferably 4 or less, and still more preferably 3.5 or less. To control the specific dielectric constant of dielectric liquid in such a range is preferred since an electric filed is efficiently applied to the charged particles in the dielectric liquid.

Examples of the dispersion medium used in the invention include a straight chain or branched aliphatic hydrocarbon, an alicyclic hydrocarbon, an aromatic hydrocarbon, halogen-substituted products of these hydrocarbons, and a silicone oil. Specific examples thereof include hexane, heptane, octane, isooctane, decane, isodecane, decalin, nonane, dodecane, isododecane, cyclohexane, cyclooctane, cyclodecane, toluene, xylene, mesitylene, Isopar C, Isopar E, Isopar G, Isopar H, Isopar L and Isopar M ("Isopar" is a brand name of Exxon Corp.), Shellsol 70 and Shellsol 71 ("Shellsol" is a brand name of Shell Oil Co.), Amsco OMS and Amsco 460 solvent ("Amsco" is a brand name of American Mineral Spirits Corp.), and KF-96L (brand name of Shin-Etsu Silicone Co., Ltd.), which may be used individually or as a mixture.

The content of the dispersion medium in the whole ink composition is preferably in a range of from 20 to 99% by weight. The particles containing a colorant can be well dispersed in the dispersion medium with the content of the dispersion medium of 20% by weight or more, and the content of a colorant is sufficient with the content of the dispersion medium of 99% by weight or less.

Colorant

Known dyes and pigments can be used as the colorant for use in the invention, and are appropriately selected depending on use and purpose. For instance, from the standpoint of color tone of a recorded image material (printed material), a pigment is preferably used (as described, for example, in "Ganryo Bunsan Anteika to Hyomen Shori Gijutu-Hyoka" (Pigment Dispersion Stabilization and Surface Treatment Technique and Evaluation), First Edition, published by Gijutsu Joho Kyokai Co., Ltd. (Dec. 25, 2001), which is hereinafter sometimes referred to as Non-patent Document 1). Inks of four colors, i.e., yellow, magenta, cyan and black, can be prepared by changing the colorant. In particular, pigments that are used in offset printing inks or proofs are preferably used, because color tones similar to offset printed materials can be obtained.

Examples of the pigment for a yellow ink include a monoazo pigment, for example, C.I. Pigment Yellow 1 or C.I. Pigment Yellow 74, a disazo pigment, for example, C.I. Pigment Yellow 12 or C.I. Pigment Yellow 17, a non-benzidine azo pigment, for example, C.I. Pigment Yellow 180, an azo lake pigment, for example, C.I. Pigment Yellow 100, a condensed azo pigment, for example, C.I. Pigment Yellow 95, an acidic dye lake pigment, for example, C.I. Pigment Yellow 15, a basic dye lake pigment, for example, C.I. Pigment Yellow 18, an anthraquinone pigment, for example, Flavanthrone Yellow, an isoindolinone pigment, for example, Isoindolinone Yellow 3RLT, a quinophthalone pigment, for example, Quinophthalone Yellow, an isoindoline pigment, for example, Isoindoline Yellow, a nitroso pigment, for example, C.I. Pigment Yellow 153, a metallic complex azomethine pigment, for example, C.I. Pigment Yellow 117, and an isoindolinone pigment, for example, C.I. Pigment Yellow 139.

Examples of the pigment for a magenta ink include a monoazo pigment, for example, C.I. Pigment Red 3, a disazo pigment, for example, C.I. Pigment Red 38, an azo lake pigment, for example, C.I. Pigment Red 53:1 or C.I. Pigment Red 57:1, a condensed azo pigment, for example, C.I. Pigment Red 144, an acidic dye lake pigment, for example, C.I. Pigment Red 174, a basic dye lake pigment, for example, C.I. Pigment Red 81, an anthraquinone pigment, for example, C.I. Pigment Red 177, a thioindigo pigment, for example, C.I. Pigment Red 88, a perynone pigment, for example, C.I. Pigment Red 194, a perylene pigment, for example, C.I. Pigment Red 149, a quinacridone pigment, for example, C.I. Pigment Red 122, an isoindolinone pigment, for example, C.I. Pigment Red 180, and an alizarin lake pigment, for example, C.I. Pigment Red 83.

Examples of the pigment for a cyan ink include a disazo pigment, for example, C.I. Pigment Blue 25, a phthalocyanine pigment, for example, C.I. Pigment Blue 15, an acidic dye lake pigment, for example, C.I. Pigment Blue 24, a basic dye lake pigment, for example, C.I. Pigment Blue 1, an anthraquinone pigment, for example, C.I. Pigment Blue 60, and an alkali blue pigment, for example, C.I. Pigment Blue 18.

Examples of the pigment for a black ink include an organic pigment, for example, an aniline black pigment, an iron oxide pigment, and a carbon black pigment, for example, furnace black, lamp black, acetylene black and channel black.

A processed pigment represented by a Microlith pigment, for example, Microlith-A, -K or -T, can also be preferably used. Specific examples thereof include Microlith Yellow 4G-A, Microlith Red BP-K, Microlith Blue 4G-T and Microlith Black C-T.

Various kinds of other pigments may be used, if desired, for example, calcium carbonate or titanium oxide as a pigment for a white ink, aluminum powder for a silver ink, and a copper alloy for a gold ink.

It is preferred that only one kind of a pigment is essentially used for one color from the standpoint of simplicity in the production of ink, but in some cases, two or more kinds of pigments are preferably used in combination. For instance, phthalocyanine is mixed with carbon black to produce a black ink. The pigment may be used after subjecting to a surface treatment by a known method, for example, a rosin treatment (as described in Non-patent Document 1 above).

The content of the pigment in the whole ink composition is preferably in a range of from 0.1 to 50% by weight. The pigment amount is sufficient to provide good coloration on printed material with the content of 0.1% by weight or more, and the particles containing the colorant can be dispersed in the dispersion medium in good condition with the content of 50% by weight or less. The content of the colorant is more preferably from 1 to 30% by weight.

Coating Agent

In the invention, it is preferred that the colorant, for example, a pigment is dispersed (reduced to particles) in the dispersion medium in the state coated with a coating agent rather than the colorant is directly dispersed (reduced to particles) therein. The charge owned by the colorant can be shielded by coating with the coating agent, whereby the desired charging characteristics can be imparted. Further, in the invention, after the inkjet recording onto a recording medium, the image thus recorded is fixed with heating means, for example, a heat roller, and at that time the coating agent is melted by heat to fix the image efficiently.

Examples of the coating agent include a rosin compound, a rosin-modified phenol resin, an alkyd resin, a (meth) acrylic polymer, polyurethane, polyester, polyamide, polyethylene, polybutadiene, polystyrene, polyvinyl acetate, an acetal-modified product of polyvinyl alcohol and polycarbonate. Among these, a polymer having a weight average molecular weight of from 2,000 to 1,000,000 and a polydispersion degree (weight average molecular weight/number average molecular weight) of from 1.0 to 5.0 is preferred in view of easiness in particle formation. Furthermore, a polymer having any one of a softening point, a glass transition point and a melting point of from 40 to 120° C. is preferred from the standpoint of easiness in fixation.

Preferred examples of the coating agent used in the invention include a polymer containing at least one of constituting units represented by the following formulae (1) TO (4).

(1)

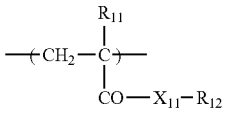

-continued (2)

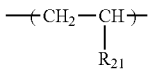

(3)

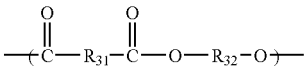

(4)

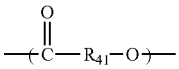

In the formulae, $X_{11}$ represents an oxygen atom or —N($R_{13}$)—; $R_{11}$ represents a hydrogen atom or a methyl group; $R_{12}$ represents a hydrocarbon group having from 1 to 30 carbon atoms; $R_{13}$ represents a hydrogen atom or a hydrocarbon group having from 1 to 30 carbon atoms; $R_{21}$ represents a hydrogen atom or a hydrocarbon group having from 1 to 20 carbon atoms; and $R_{31}$, $R_{32}$ and $R_{41}$ each independently represents a divalent hydrocarbon group having from 1 to 20 carbon atoms. The hydrocarbon group represented by any one of $R_{12}$, $R_{21}$, $R_{31}$, $R_{32}$ and $R_{41}$ may contain an ether bond, an amino group, a hydroxy group or a halogen-substituted group.

The polymer having the constituting unit represented by formula (1) can be obtained by radical polymerization of a corresponding radical polymerizable monomer according to a known method. Examples of the radical polymerizable monomer include a (meth)acrylate, for example, methyl (meth)acrylate, ethyl (meth)acrylate, propyl (meth)acrylate, butyl (meth)acrylate, hexyl (meth)acrylate, octyl (meth) acrylate, 2-ethylhexyl (meth)acrylate, dodecyl (meth)acrylate, stearyl (meth)acrylate, cyclohexyl (meth)acrylate, phenyl (meth)acrylate, benzyl (meth)acrylate or 2-hydroxyethyl (meth)acrylate, and a (meth)acrylamide, for example, N-methyl(meth)acrylamide, N-propyl(meth)acrylamide, N-phenyl(meth)acrylamide or N,N-dimethyl(meth)acrylamide.

The polymer having the constituting unit represented by formula (2) can be obtained by radical polymerization of a corresponding radical polymerizable monomer according to a known method. Examples of the radical polymerizable monomer include ethylene, propylene, butadiene, styrene and 4-methylstyrene.

The polymer having the constituting unit represented by formula (3) can be obtained by dehydration condensation of a corresponding dicarboxylic acid or acid anhydride with a diol according to a known method. Examples of the dicarboxylic acid and acid anhydride include succinic anhydride, adipic acid, sebacic acid, isophthalic acid, terephthalic acid, 1,4-phenylenediacetic acid and diglycolic acid. Examples of the diol include ethylene glycol, 1,2-propanediol, 1,3-propanediol, 1,4-butanediol, 1,6-hexanediol, 1,10-decanediol, 2-butene-1,4-diol, 1,4-cyclohexanediol, 1,4-cyclohexanedimethanol, 1,4-benzenedimethanol and diethylene glycol.

The polymer having the constituting unit represented by formula (4) can be obtained by dehydration condensation of a corresponding carboxylic acid having a hydroxy group according to a known method, or by ring-opening polymerization of a cyclic ester of a corresponding carboxylic acid having a hydroxy group according to a known method. Examples of the carboxylic acid having a hydroxy group and cyclic ester thereof include 6-hydroxyhexanoic acid, 11-hydroxyundecanoic acid, hydroxybenzoic acid and ϵ-caprolactone.

The polymer containing at least one constituting unit represented by any one of formulae (1) to (4) may be a homopolymer of the constituting unit represented by any one of formulae (1) to (4), or may be a copolymer with other constituting component. The polymers may be used individually or in combination of two or more thereof, as the coating agent.

The content of the coating agent in the whole ink composition is preferably in a range of from 0.1 to 40% by weight. The amount of the coating agent is sufficient to provide satisfactory fixing property with the content of 0.1% by weight or more, and particles containing the colorant and the coating agent can be produced in good condition with the content of 40% by weight or less.

Dispersing Agent

According to the invention, a mixture of the colorant and the coating agent is preferably dispersed (reduced to particles) in the dispersion medium. It is more preferred to use a dispersing agent for the purpose of controlling the particle diameter and preventing the precipitation of particles.

Preferred examples of the dispersing agent include a surface active agent represented by a sorbitan fatty acid ester, for example, sorbitan monooleate, and a polyethylene glycol fatty acid ester, for example, polyoxyethylene distearate. Examples thereof further include a copolymer of styrene and maleic acid and an amine-modified product thereof, a copolymer of styrene and (meth)acrylic compound, a (meth)acrylic polymer, a copolymer of ethylene and (meth)acrylic compound, rosin, BYK-160, 162, 164 and 182 (brand names of polyurethane polymers, produced by BYK Chemie GmbH), EFKA-401 and 402 (brand names of acrylic polymers, produced by EFKA Additives B.V.), and Solsperse 17000 and 24000 (brand names of polyester polymers, produced by Zeneca PLC). According to the invention, such a polymer having a weight average molecular weight of from 1,000 to 1,000,000 and a polydispersion degree (weight average molecular weight/number average molecular weight) of from 1.0 to 7.0 is preferably used from the standpoint of storage stability of the ink composition for a long period of time. A graft polymer and a block polymer are most preferably used.

Particularly preferred examples of the polymer used as the dispersing agent in the invention include a graft polymer comprising a polymer component containing at least one of constituting units represented by formulae (5) and (6) shown below and a polymer component containing at least a graft chain containing a constituting unit represented by formula (7) shown below.

(5)

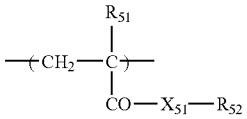

(6)

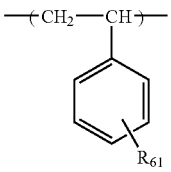

-continued (7)

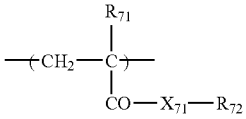

In the formulae, $X_{51}$ represents an oxygen atom or —N($R_{53}$)—; $R_{51}$ represents a hydrogen atom or a methyl group; $R_{52}$ represents a hydrocarbon group having from 1 to 10 carbon atoms; $R_{53}$ represents a hydrogen atom or a hydrocarbon group having from 1 to 10 carbon atoms; $R_{61}$ represents a hydrogen atom, a hydrocarbon group having from 1 to 20 carbon atoms, a halogen atom, a hydroxy group or an alkoxy group having from 1 to 20 carbon atoms; $X_{71}$ represents an oxygen atom or —N($R_{73}$)—; $R_{71}$ represents a hydrogen atom or a methyl group; $R_{72}$ represents a hydrocarbon group having from 4 to 30 carbon atoms; and $R_{73}$ represents a hydrogen atom or a hydrocarbon group having from 1 to 30 carbon atoms. The hydrocarbon group represented by any one of $R_{52}$ and $R_{72}$ may contain an ether bond, an amino group, a hydroxyl group or a halogen-substituted group.

The graft polymer can be obtained in such a manner that a radical polymerizable monomer corresponding to formula (7) is polymerized, preferably in the presence of a chain transfer agent, a polymerizable functional group is introduced into a terminal of the resulting polymer, and the macromonomer thus formed is then copolymerized with a radical polymerizable monomer corresponding to any one of formulae (5) and (6).

Examples of the radical polymerizable monomer corresponding to formula (5) include a (meth)acrylate, for example, methyl (meth)acrylate, ethyl (meth)acrylate, propyl (meth)acrylate, butyl (meth)acrylate, hexyl (meth)acrylate, cyclohexyl (meth)acrylate, phenyl (meth)acrylate, benzyl (meth)acrylate or 2-hydroxyethyl (meth)acrylate, and a (meth)acrylamide, for example, N-methyl(meth)acrylamide, N-propyl(meth)acrylamide, N-phenyl(meth)acrylamide or N,N-dimethyl(meth)acrylamide.

Examples of the radical polymerizable monomer corresponding to formula (6) include styrene, 4-methylstyrene, chlorostyrene and methoxystyrene.

Examples of the radical polymerizable monomer corresponding to formula (7) include hexyl (meth)acrylate, octyl (meth)acrylate, 2-ethylhexyl (meth) acrylate, dodecyl (meth)acrylate and stearyl (meth)acrylate.

Specific examples of the graft polymer include polymers represented by the following structural formulae.

[BZ-1]

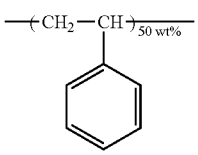

-continued

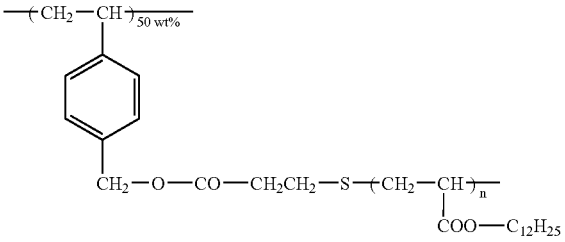

[BZ-2]

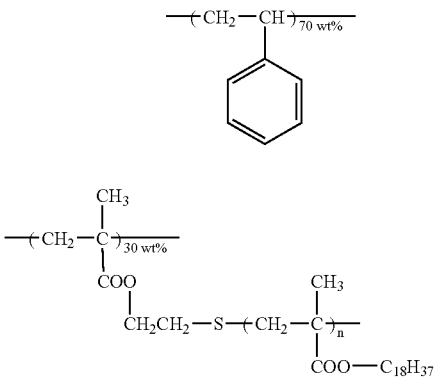

[BZ-3]

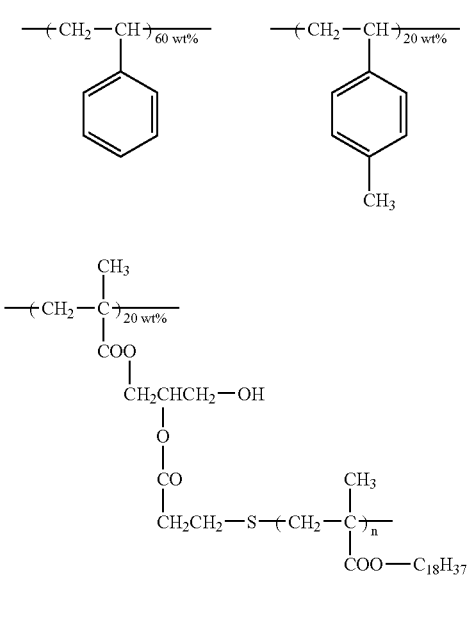

[BZ-4]

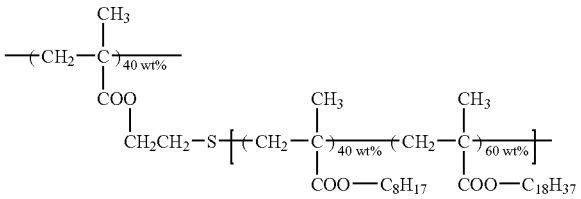

-continued

[BZ-5]

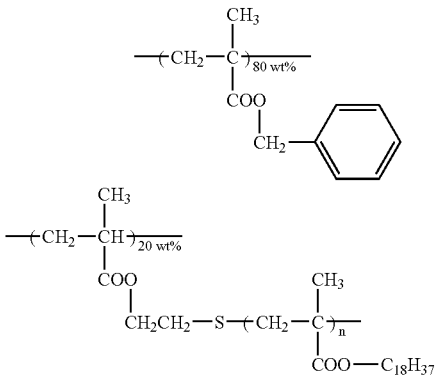

[BZ-6]

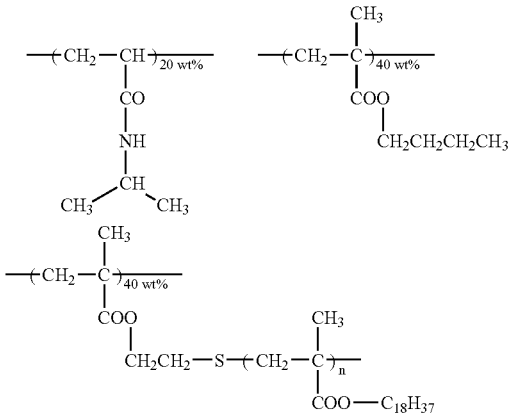

The graft polymer comprising a polymer component containing at least one of constituting units represented by formulae (5) and (6) and a polymer component containing at least a graft chain containing a constituting unit represented by formula (7) may contain only the constituting units represented by formulae (5) and/or (6) and formula (7), and may also contain other constituting component. The weight ratio of the polymer component containing the graft chain and the other polymer component is preferably in a range of from 10/90 to 90/10. The range is preferred since formation of particles can be attained in good condition and the desired particle diameter can be easily obtained. The polymers may be used individually or in combination of two or more thereof, as the dispersing agent.

The content of the dispersing agent in the whole ink composition is preferably in a range of from 0.01 to 30% by weight. Within such a range, the formation of particles can be attained in good condition and the desired particle diameter can be obtained.

Charge Controlling Agent

According to the invention, a mixture of the colorant and the coating agent is preferably dispersed (reduced to particles) in the dispersion medium using the dispersing agent. It is more preferred to use together a charge controlling agent for the purpose of controlling the charge amount of particles.

Preferred examples of the charge controlling agent include metal salts of organic carboxylic acids, for example, zirconium naphthenate and zirconium octenate, ammonium salts of organic carboxylic acids, for example, tetramethylammonium stearate, metal salts of organic sulfonic acids, for example, sodium dodecylbenzenesulfonate and magnesium dioctylsulfosuccinate, ammonium salts of organic sulfonic acids, for example, tetrabutylammonium toluenesulfonate, polymers having carboxylic acid groups in the side chains thereof, for example, a polymer containing carboxylic acid groups obtained by modification of a copolymer of styrene and maleic anhydride with an amine, polymers having carboxylic acid anion groups in the side chains thereof, for example, a copolymer of stearyl methacrylate and tetramethylammonium methacrylate, polymers having nitrogen atoms in the side chains thereof, for example, a copolymer of styrene and vinyl pyridine, and polymers having ammonium groups in the side chains thereof, for example, a copolymer of butyl methacrylate and N-(2-methacroyloxyethyl)-N,N,N-trimethylammonium tosilate. The charge to be applied to the particle may be positive charge or negative charge.

The content of the charge controlling agent in the whole ink composition is preferably in a range of from 0.0001 to 10% by weight.

Other Components

According to the invention, other components, for example, an antiseptic agent for preventing decomposition or a surface active agent for controlling surface tension may further be incorporated into the ink composition depending on purposes.

Preparation of Charged Particles

The ink composition containing the charged particles according to the invention can be prepared by dispersing (reducing to particles) the colorant and preferably the coating agent, if desired, together with the above-described components. Examples of the method for dispersing (reducing to particles) include the following methods.

(1) The colorant and the coating agent are mixed, the mixture is dispersed (reduced to particles) by using the dispersing agent and the dispersion medium, and then the charge controlling agent is added to the resulting dispersion.

(2) The colorant, the coating agent, the dispersing agent and the dispersion medium are simultaneously dispersed (reduced to particles), and then the charge controlling agent is added to the resulting dispersion.

(3) The colorant, the coating agent, the dispersing agent, the charge controlling agent and the dispersion medium are simultaneously dispersed (reduced to particles).

Examples of an apparatus for use at the mixing or dispersing include a kneader, a disolver, a mixer, a high-speed disperser, a sand mill, a roll mill, a ball mill, an attritor and a beads mill (as described in Non-patent Document 1 described above).

The ink composition for use in the invention comprises an initial feeding ink composition and a replenishing ink composition and has a feature in that a relationship between both ink compositions satisfies any one of conditions defined in the following two embodiments.

Specifically, according to a first embodiment, the ink composition for use in the invention comprises an initial feeding ink composition and a replenishing ink composition and solid content concentration of the replenishing ink composition is controlled higher than solid content concentration of the initial feeding ink composition.

According to a second embodiment, the ink composition for use in the invention comprises an initial feeding ink composition and a replenishing ink composition and an average particle diameter of the charged particles in the replenishing ink composition is controlled larger than an average particle diameter of the charged particles in the initial feeding ink composition.

Each embodiment will be described in detail below.

In the first embodiment, each of the solid content concentrations of the initial feeding ink composition and the replenishing ink composition is not particularly restricted as long as the above-described condition is satisfied. For example, however, it is desired that the solid content concentration of the initial feeding ink composition is adjusted from 1 to 40% by weight, the solid content concentration of the replenishing ink composition is adjusted from 2 to 60% by weight, and a ratio of the solid content concentration between the initial feeding ink composition and the replenishing ink composition is adjusted from 1.05 to 10.0, preferably from 1.1 to 7.0, in terms of a ratio of the latter/the former. By fulfilling these conditions, a more preferred ejection property can be achieved. Further, defective mixing between the initial feeding ink composition and the replenishing ink composition does not occur. Preferred solid content concentration of the initial feeding ink composition is from 3 to 30% by weight, and preferred solid content concentration of the replenishing ink composition is from 5 to 50% by weight.

The solid content concentration of the ink composition can be calculated based on change in weight after heating the ink composition to remove volatile components. For example, the ink composition is dried on a hot plate at 145° C. for 2 hours and the solid content concentration is calculated based on the change in weight.

In the first embodiment, it is desired that electric conductivity of the initial feeding ink composition at 20° C. is adjusted from 10 to 50,000 pS/cm (1 to 5,000 nS/m), and electric conductivity of the replenishing ink composition is from 50 to 100,000 pS/cm (5 to 10,000 nS/m). By adjusting the electric conductivities of the ink compositions in the above-ranges, a preferred ejection property can be achieved. Further, it is more preferred to adjust the electric conductivity of the replenishing ink composition higher than that of the initial feeding ink composition, because the good ejection property is maintained for a long period of time. The electric conductivity of the ink composition can be adjusted depending on kinds and amounts added of a dispersion medium and a charge controlling agent used.

In the first embodiment, a volume average diameter of the charged particles is preferably from 0.20 to 5.0 μm. By adjusting the volume average diameter of the charged particles in the above-range, a preferred ejection property can be achieved. The volume average diameter of the charged particles can be measured by a centrifugal precipitation method using, for example, a super-centrifugal type automatic particle size distribution measuring apparatus (CAPA-700, manufactured by Horiba, Ltd.). The volume average diameter of the charged particles can be adjusted depending on a kind and an amount added of a dispersing agent used and an apparatus used for dispersion (reduction to particles).

In the second embodiment, each of the average particle diameters of the charged particles of the initial feeding ink composition and the replenishing ink composition is not particularly restricted as long as the above-described condition is satisfied. For example, however, it is desired that a volume average particle diameter (DS) of the charged particles of the initial feeding ink composition is adjusted from 0.20 to 4.5 μm, preferably from 0.3 to 4.0 μm, a volume average particle diameter (DR) of the charged particles of the replenishing ink composition is adjusted from 0.21 to 5.0 μm, preferably from 0.35 to 4.5 μm, and a relation between DS and DR is adjusted from 1.05 to 4.0, preferably from 1.1 to 3.0, in terms of a ratio of DR/DS. By adjusting the ratio of DR/DS to 1.05 or more, an ejection property can be more improved. Also, by adjusting the ratio of DR/DS to 4.0 or less, variation of the ejection property just after the replenishment of the replenishing ink composition can be prevented.

In the second embodiment, concentration of the charged particles in the ink composition is desirably from 1 to 60% by weight, preferably from 3 to 50% by weight. By adjusting the concentration of the charged particles in the ink composition in the above-range, a preferred ejection property can be achieved. Further, it is more preferred to adjust the concentration of the charged particles in the replenishing ink composition higher than that of the initial feeding ink composition, because the good ejection property is further maintained. The concentration of the charged particles can be expressed using the solid content concentration of the ink composition.

In the second embodiment, it is desired that electric conductivity of the ink composition at 20° C. is adjusted from 10 to 100,000 pS/cm (1 to 10,000 nS/m). By adjusting the electric conductivity of the ink composition in the above-range, a preferred ejection property can be achieved. Further, it is more preferred to adjust the electric conductivity of the replenishing ink composition higher than that of the initial feeding ink composition, because the good ejection property is maintained for a long period of time. The electric conductivity of the ink composition can be adjusted depending on kinds and amounts added of a dispersion medium and a charge controlling agent used.

In the invention, viscosity of the ink composition described above (including the initial feeding ink composition and the replenishing ink composition) at 20° C. is preferably in a range of from 0.5 to 50 mPa·s. By adjusting the viscosity of the ink composition in the above-range, a preferred ejection property can be achieved. The viscosity of the ink composition can be adjusted depending on kinds and amounts of a dispersion medium and a polymer component, for example, a dispersing agent, dissolved in the dispersion medium. Moreover, the viscosity of the ink composition can be adjusted by further using a surfactant.

Inkjet Recording Apparatus

According to the invention, the ink composition described above is used for recordation on a recording medium by an inkjet recording system. In the invention, it is preferred to use an inkjet recording system utilizing an electrostatic field. In the inkjet recording system utilizing an electrostatic field, a voltage is applied between a control electrode and a back electrode positioned on the back side of the recording medium, whereby the charged particles in the ink composition are concentrated at an ejection position through an electrostatic force to cause the ink composition to fly from the ejection position to the recording medium. With respect to the voltage applied between the control electrode and the back electrode, in case of using the charged particles having positive charge, for example, the control electrode acts as a positive electrode and the back electrode acts as a negative electrode. The same effect can be obtained by charging the recording medium instead of the application of voltage to the back electrode.

Examples of the method for flying an ink include a method of flying an ink from a tip of a member having a needle shape such as an injection needle, which can be used for recordation with the ink composition described above. In the method, however, replenishment of the charged particles after the concentration of charged particles and ejection is difficult, and thus it is difficult to stably conduct the recordation for a long period of time. Since the charged particles are forcedly supplied in the method, the ink is overspilled from the tip of the injection needle in the case of circulating the ink. Accordingly, the meniscus shape at the tip of the injection needle at the ejection position is not stabilized to make stable recordation difficult. Therefore, the method is suitable for recordation for a short period of time.

On the contrary, a method in which the ink composition is circulated without spillover of the ink composition from an ejection opening is preferably used. For instance, a method wherein an ink is circulated in an ink chamber having an ejection opening and a voltage is applied to a control electrode formed around the ejection opening to cause concentrated ink droplets to fly from a tip of an ink guide disposed in the ejection opening and directed to a recording medium simultaneously satisfies both the replenishment of the charged particles by circulation of the ink composition and the stabilization of the meniscus at the ejection position. Thus, the method is capable of perform stable recordation for a long period of time. Furthermore, since the ink comes in contact with the outside air only at a significantly small area, i.e., the ejection opening, the solvent can be prevented from being evaporated to stabilize the physical property of the ink composition. Accordingly, the method is preferably used in the invention.

An example of a construction of an inkjet recording apparatus suitable for application of the ink composition according to the invention will be described below.

An apparatus for performing four color printing on one side of a recording medium as shown in FIG. 1 will be described below. The inkjet recording apparatus 1 shown in FIG. 1 has an ejection head 2 for conducting full color image formation constituted by ejection heads 2C, 2M, 2Y and 2K for four colors, an ink circulation system 3 for supplying an ink to the ejection head 2 and recovering the ink from the ejection head 2, a head driver 4 for driving the ejection head 2 based on output from an external device, for example, a computer or RIP, which is not shown, and a position controlling means 5. The inkjet recording apparatus 1 also has a conveying belt 7 stretched with three rollers 6A, 6B and 6C, a conveying belt position detecting means 8 constituted by an optical sensor or the like capable of detecting the position in the width direction of the conveying belt 7, an electrostatic adsorption means 9 for retaining a recording medium P on the conveying belt 7, and a static eliminating means 10 and a mechanical means 11 for releasing the recording medium P from the conveying belt 7 after the completion of image formation. A feed roller 12 and a guide 13 for feeding the recording medium P from a paper stock, which is not shown, to the conveying belt 7 are disposed on the upstream side of the conveying belt 7, and an image fixing means 14 and a guide 15 for fixing the ink on the recording medium P after releasing and conveying the recording medium P to a paper stocker, which is not shown, are disposed on the downstream side of the conveying belt 7. The inkjet recording apparatus 1 has a recording medium position detecting means 16 at a position opposite to the ejection head with respect to the conveying belt 7, and a solvent recover part containing an exhaust fan 17 and a solvent vapor adsorbent 18 for recovering a solvent vapor generated from the ink composition, by which the vapor inside the apparatus is exhausted to the exterior of the apparatus through the solvent recover part.

The feed roller 12 is disposed to improve feeding capability of the recording medium. As the feed roller, a known roller may be used. Since the recording medium P often has dusts and paper powder attached thereon, it is desired to remove these materials. The recording medium P thus fed by the feed roller 12 is conveyed to the conveying belt 7 through the guide 13. The back surface (preferably a metallic back surface) of the conveying belt 7 is disposed through the roller 6A. The recording medium thus conveyed is electrostatically adsorbed on the conveying belt with the electrostatic adsorption means 9. In the embodiment shown in FIG. 1, the electrostatic adsorption is attained by a scorotron charging device connected to a negative high voltage electric source. The recording medium P is electrostatically adsorbed on the conveying belt 7 without space and is uniformly charged over the surface thereof by the electrostatic adsorption means 9. While the electrostatic adsorption means is also used as a charging means of the recording medium in this embodiment, these means may be separately provided. The recording medium P thus charged is conveyed by the conveying belt 7 to the position of the ejection head, and recording signal voltage is superposed on the charged potential as bias to attain electrostatic inkjet image formation. The recording medium P having the image thereon is subjected to elimination of static by the static eliminating means 10 and released from the conveying belt 7 by the mechanical means 11, followed by being conveyed to the fixing part. The recording medium P thus released is delivered to the image fixing means 14 for fixing. The recording medium P thus fixed is delivered to the paper stocker, which is not shown. The apparatus has a recovery means for the solvent vapor generated from the ink composition. The recovery means has the solvent vapor adsorbent 18. The gas containing the solvent vapor inside the apparatus is introduced into the absorbent by the exhaust fan 17, and after adsorbing and recovering the solvent vapor, the gas is exhausted to the exterior of the apparatus. The apparatus is not limited to the above-described embodiment, and the numbers, shapes, relative positions and charging polarities of the constituting devices including, for example, the roller and the charging device, can be appropriately selected. Further, while the four-color printing is attained in the above-described system, multi-color systems exceeding four colors may be constituted by combining a light-color ink and a special color ink.

The inkjet recording apparatus used in the inkjet printing system has the ejection head 2 and the ink circulation system 3. The ink circulation system 3 has an ink tank, an ink circulation device, an ink concentration controlling device, an ink temperature controlling device and the like, and the ink tank may contain a stirring device therein.

As the ejection head 2, a single channel head, a multi-channel head and a full-line head may be used, and the main scanning is carried out by movement of the conveying belt 7.

An inkjet head that can be preferably used in the invention is one for such an inkjet system that the charged particles is electrophoresed in an ink flow channel to increase the ink concentration in the vicinity of the opening, so as to eject the ink, and the ejection of ink droplets is carried out mainly through an electrostatic attraction force caused by the recording medium or a counter electrode disposed on the back side of the recording medium. Therefore, in the case where the recording medium or the counter electrode does not face the head and in the case where no voltage is applied to the recording medium or the counter electrode even though they face the head, ink droplets are not ejected even when the voltage is accidentally applied to the ejection electrode or vibration is applied to the head, whereby the interior of the apparatus is prevented from being contaminated.

Figure 2:
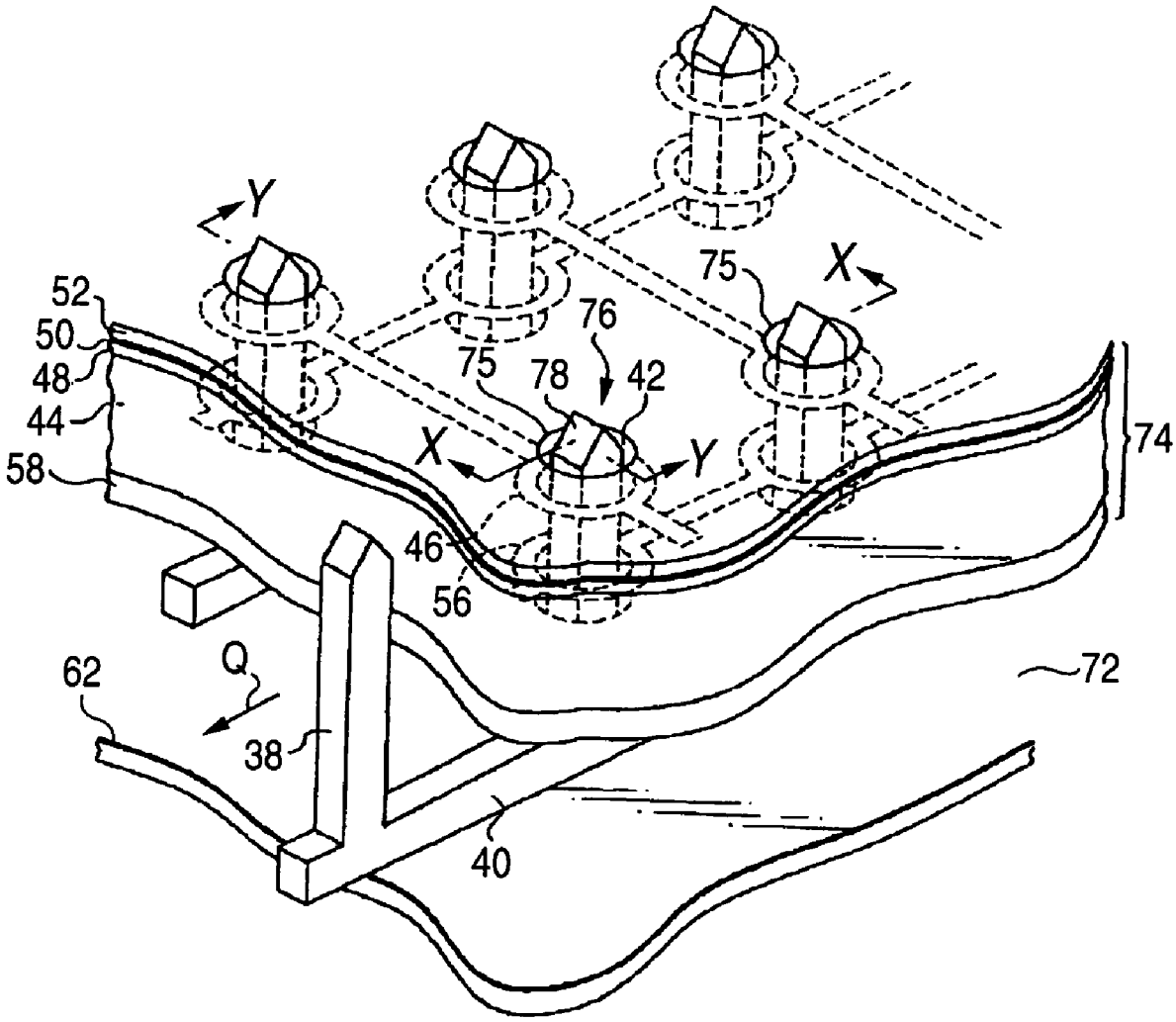
FIG. 2 is a perspective view showing a constitution of an inkjet head of the inkjet recording apparatus used in the invention. For the sake of easy understanding, an edge of guard electrode in each ejection part is not shown.
Figure 3:
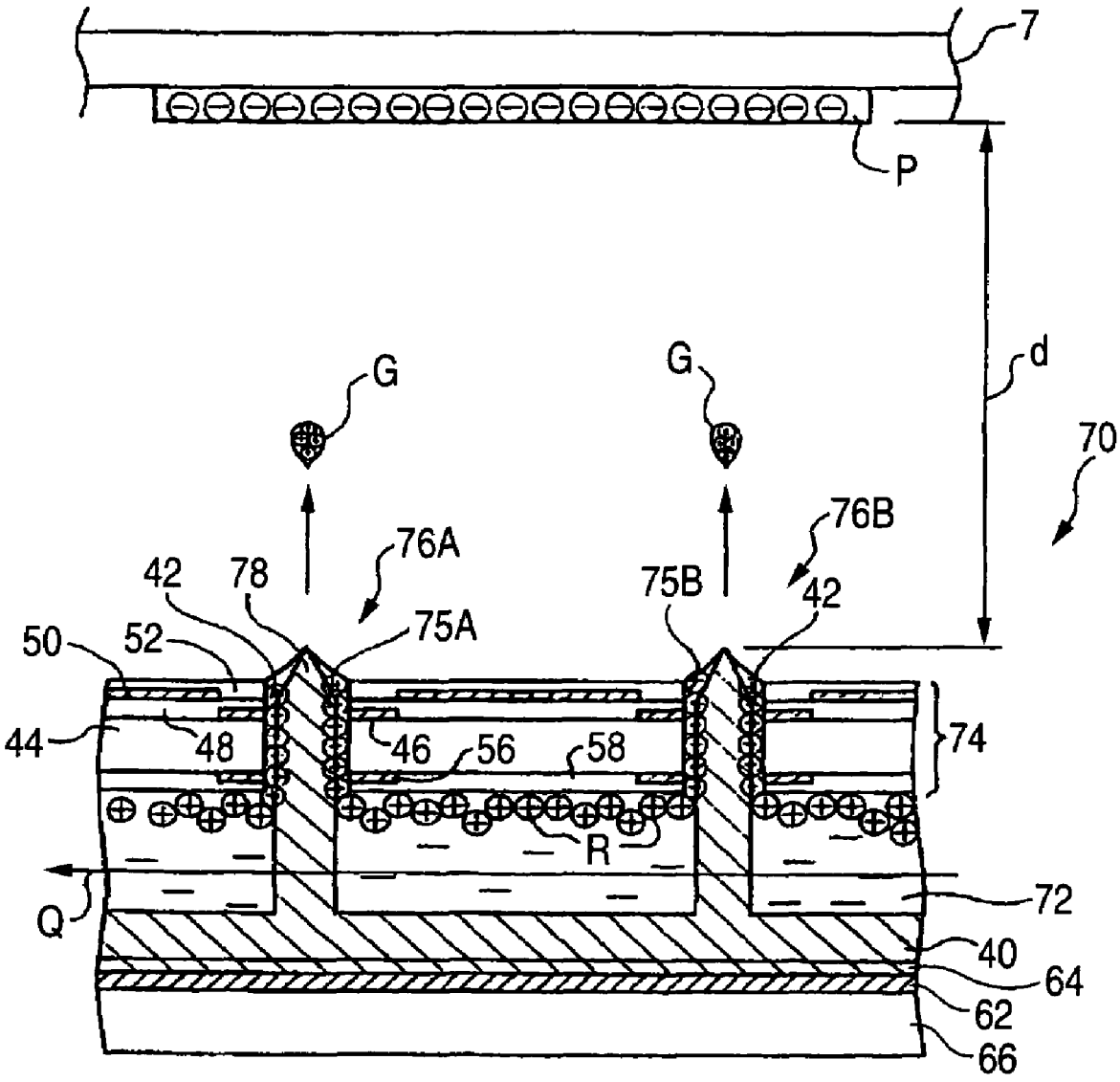
FIG. 3 is a side cross sectional view along with a line X—X in FIG. 2 showing a distribution state of charged particles where the number of ejection parts in the inkjet head shown in FIG. 2 is large.

An ejection head that is preferably used in the above-described inkjet apparatus is shown in FIGS. 2 and 3. As shown in FIGS. 2 and 3, an inkjet head 70 has a substrate 74 electrically insulating and constituting an upper wall of an ink flow channel 72 forming a unidirectional ink flow Q, and plural ejection parts 76 ejecting the ink toward the recording medium P. The ejection part 76 is provided with an ink guide part 78 for guiding an ink droplet G flying from an ink flow channel 72 toward the recording medium P, and the substrate 74 has openings 75 through which the ink guide parts 78 penetrate, respectively. An ink meniscus 42 is formed between the ink guide part 78 and an inner wall of the opening 75. A gap d between the ink guide part 78 and the recording medium P is preferably from about 200 to about 1,000 μm. The ink guide part 78 is fixed at the lower end thereof to a supporting bar 40.

The substrate 74 has an insulating layer 44 electrically insulating two ejection electrodes with a prescribed distance, a first ejection electrode 46 provided on the upper side of the insulating layer 44, an insulating layer 48 covering the first ejection electrode 46, a guard electrode 50 provided on the upper side of the insulating layer 48, and an insulating layer 52 covering the guard electrode 50. The substrate 74 also has a second ejection electrode 56 provided on the lower side of the insulating layer 44, and an insulating layer 58 covering the second ejection electrode 56. The guard electrode 50 is provided for preventing the adjacent ejection parts from the influence on electric field due to a voltage applied to the first ejection electrode 46 or the second ejection electrode 56.

The inkjet head 70 also has a floating electroconductive plate 62 constituting a bottom surface of the ink flow channel 72 in an electrically floating state. The floating electroconductive plate 62 also works to electrophorese the positively charged ink particles (charged particles) in the ink flow channel 72 upward (i.e., toward the recording medium) with an induced voltage steadily generated by a pulsewise injection voltage applied to the first ejection electrode 46 and the second ejection electrode 56. The floating electroconductive plate 62 has formed on the surface thereof a coating film 64 electrically insulating for preventing the physical property and the composition of the ink from being destabilized due to charge injection into the ink. The electrically insulating coating film preferably has an electric resistance of $10^{12}$ Ω·cm or more, and more preferably $10^{13}$ Ω·cm or more. The electrically insulating coating film is preferably corrosion resistant to the ink, whereby the floating electroconductive plate 62 is prevented from being corroded by the ink. The floating electroconductive plate 62 is covered from underneath with an insulating member 66. According to the constitution, the floating electroconductive plate 62 is in a completely electrically insulating state.

At least one floating electroconductive plate 62 is provided on each of the unit heads. For example, in the case where four unit heads of C, M, Y and K are used, the unit heads each has at least one floating electroconductive plate, and the unit heads C and M, for example, do not have one floating electroconductive plate in common.

In order to fly the ink from the inkjet head 70 to record on the recording medium P, as shown in FIG. 3, a prescribed voltage (for example, +100 V) is applied to the guard electrode 50 in such a state that the ink is circulated in the ink flow channel 72 to form an ink flow Q. Further, a positive voltage is applied to the first ejection electrode 46, the second ejection electrode 56 and the recording medium P to form such a flying electric field, among the first ejection electrode 46, the second ejection electrode 56 and the recording medium P, that the positive charged particles R in the ink droplets G flying from the opening 75 as guided with the ink guide part 78 are attracted by the recording medium P. For example, in the case where the gap d is 500 μm, the voltage may be applied such an extent that a potential difference of from about 1 to about 3.0 kV is formed.

In the above-described state, a pulse voltage is applied to the first ejection electrode 46 and the second ejection electrode 56 according to the image signal, whereby the ink droplets G with an increased charge particle concentration are ejected from the opening 75. For example, in the case where the initial charged particle concentration is from 3 to 15%, the charged particle concentration of the ink droplets G is 30% or more.

At that time, the voltage applied to the first ejection electrode 46 and the second ejection electrode 56 is previously adjusted in such a manner that the ink droplets G are ejected only when the pulse voltage is applied to both the first ejection electrode 46 and the second ejection electrode 56.

Upon applying the pulsewise positive voltage, the ink droplets G fly from the opening 75 as guided by the ink guide part 78 to attach on the recording medium P, and at the same time, a positive induction voltage is generated in the floating electroconductive plate 62 by the positive voltage applied to the first ejection electrode 46 and the second ejection electrode 56. Even in the case where the voltage applied to the first ejection electrode 46 and the second ejection electrode 56 has a pulsewise form, the induction voltage is a substantially steady voltage. Therefore, the positively charged particles R in the ink flow channel 72 receive a force of moving them upward by the electric field formed among the floating electroconductive plate 62, the guard electrode 50 and the recording medium P, whereby the concentration of the charged particles R is increased in the vicinity of the substrate 74. In the case where the number of the ejection parts (i.e., channels for ejecting ink droplets) used is large as shown in FIG. 3, the number of charged particles required for ejection is also increased. In such a case, the numbers of the first ejection electrodes 46 and the second ejection electrodes 56 used are also increased to generate a higher induction voltage in the floating electroconductive plate 62, whereby the number of the charged particles R moving toward the recording medium is increased.

While the case where the colored particles are positively charged is described in the above embodiment, the colored particles may be negatively charged. In the later case, the charging polarities are all inverted.

It is preferred in the invention that after ejecting the ink on the recording medium, the ink is fixed by an appropriate heating means. Examples of the heating means used include a contact heating device, for example, a heating roller, a heating block and a heating belt, and a non-contact heating device, for example, a dryer, an infrared ray lamp, a visible ray lamp, an ultraviolet ray lamp and a hot air oven. The heating device is preferably provided continuously to the inkjet recording apparatus and integrated thereto. The temperature of the recording medium at the fixing is preferably in a range of from 40 to 200° C. from the standpoint of easiness of fixing. The period of time for fixing is preferably in a range of from 1 μsec to 20 seconds.

Replenishment of Ink Composition

In the inkjet recording system utilizing an electrostatic field, the charged particles in the ink composition is concentrated and ejected. Therefore, the amount of the charged particles in the ink composition is reduced after ejecting the ink composition for a long period of time to lower the electric conductivity of the ink composition. The ratio of the electric conductivity of the charged particles to the electric conductivity of the ink composition is also changed. Further, there is such a tendency that the charged particles having larger diameter are ejected before the charged particles having smaller diameter, and thus the average particle diameter of the charged particles is decreased. Moreover, the content of the solid matters in the ink composition is changed to vary the viscosity thereof.

The changes in physical properties of the ink composition result in ejection failure, and decrease in optical density and blur of ink occur in the image thus recorded. Accordingly, the replenishing ink composition having a higher concentration (a higher solid content concentration) than the initial feeding ink composition initially charged in the ink tank is replenished to prevent decrease in the concentration of the charged particles, or the replenishing ink composition containing the charged particles having a larger average particle diameter than an average particle diameter of the initial feeding ink composition initially charged in the ink tank is replenished to prevent decrease in the amount of the charged particles, whereby the electric conductivity of the ink composition can be maintained within a certain range. The average particle diameter of the charged particles and the viscosity of the ink composition can also be maintained. Furthermore, since the physical properties of the ink composition are maintained within certain ranges, the ejection of ink can be performed stably and uniformly for a long period of time. The replenishment is preferably carried out mechanically or by humans after the physical properties of the ink composition, for example, the electric conductivity or the optical density, are detected to calculate the necessary replenishing amount. The replenishment may also be carried out mechanically or by humans after calculation of an amount of the ink composition to be used based on an image data.

Recording Medium

In the invention, various kinds of recording media may be used depending on use. For example, a printed material can be directly obtained by inkjet recording on paper, a plastic film, a metal, paper having a plastic or a metal laminated or deposited thereon, or a plastic film having a metal laminated or deposited thereon. An offset printing plate can be obtained by using a metallic support, for example, aluminum, having a roughened surface. A flexographic printing plate and a color filter for a liquid crystal display can be obtained by using a plastic support. The recording medium may have a flat shape, for example, a sheet form, or a stereoscopic shape, for example, a cylindrical form. The invention can also be applied to the production of a semiconductor device and a printed circuit board by using a silicon wafer and a circuit board as the recording medium.

According to the inkjet recording method of the invention, image recorded materials having a high image density and high image quality without blur of ink can be stably obtained for a long period of time.

The invention will be described in more detail with reference to the following examples, but the invention should not be construed as being limited thereto.

EXAMPLE 1

Materials Used

The following materials were used in Example 1.

Cyan pigment (colorant): Phthalocyanine pigment, C.I. Pigment Blue (15:3) (LIONOL BLUE FG-7350, manufactured by Toyo Ink Mfg. Co., Ltd.)

Coating agent: [AP-1]

Dispersing agent: [BZ-2]

Charge controlling agent: [CT-1]

Dispersion medium: Isopar G (manufactured by Exxon Corp.)

The structures of Coating agent [AP-1], Dispersing agent [BZ-2] and Charge controlling agent [CT-1] are shown below.

[AP-1]

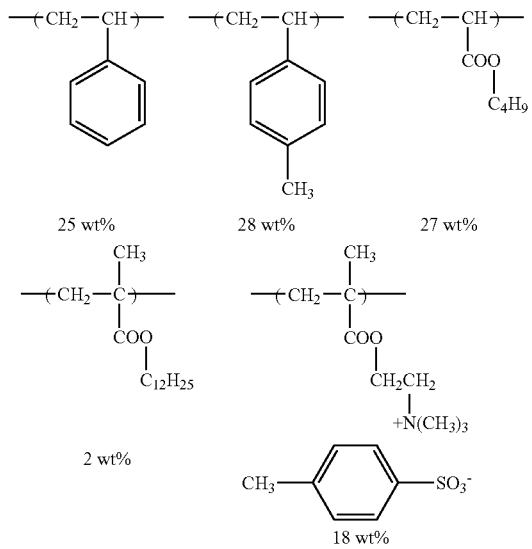

[BZ-2]

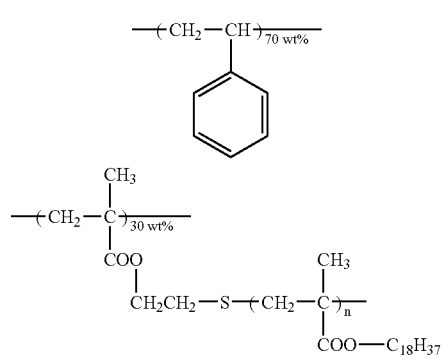

[CT-1]

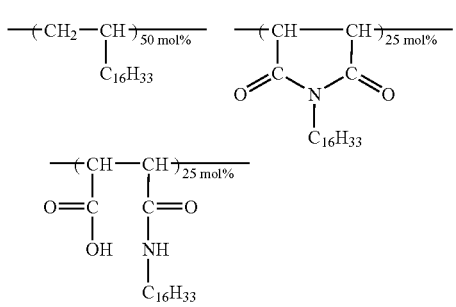

Coating agent [AP-1] was obtained by conducting radical polymerization of styrene, 4-methylstyrene, butyl acrylate, dodecyl methacrylate and 2-(N,N-dimethylamino)ethyl methacrylate using a known polymerization initiator, and reacting the resulting polymer with methyl tosylate. Coating agent [AP-1] had a weight average molecular weight of 15,000, a polydispersion degree (weight average molecular weight/number average molecular weight) of 2.7, a glass transition point (mid-point) of 51° C., and a softening point measured by a strain gauge method of 46° C.

Dispersing agent [BZ-2] was obtained by conducting radical polymerization of stearyl methacrylate in the presence of 2-mercaptoethanol, reacting the resulting polymer with methacrylic anhydride to obtain a stearyl methacrylate polymer having a methacryloyl group at the terminal thereof (having a weight average molecular weight of 7,600), and conducting radical polymerization of the polymer with styrene. Dispersing agent [BZ-2] had a weight average molecular weight of 110,000.

Charge controlling agent [CT-1] was obtained by reacting a copolymer of 1-octadecene and maleic anhydride with 1-hexadecylamine. Charge controlling agent [CT-1] had a weight average molecular weight of 17,000.

Preparation of Initial Feeding Ink Composition [DC-1S]

In a desktop kneader (PBV-0.1, manufactured by Irie Shokai Co., Ltd.) were charged 10 g of the cyan pigment and 20 g of Coating agent [AP-1], and the components were mixed under heating at a heater temperature set at 100° C. for 2 hours. Thirty grams of the mixture thus obtained was coarsely pulverized in a trio blender (manufactured by Trio Science Co., Ltd.), and then finely pulverized in a sample mill (Model SK-M10, manufactured by Kyoritsu Riko Co., Ltd.). Thirty grams of the finely pulverized product thus obtained was preliminary dispersed in a paint shaker (manufactured by Toyo Seiki Seisaki-Sho, Ltd.) together with 7.5 g of Dispersing agent (BZ-2), 75 g of Isopar G and glass beads having a diameter of about 3.0 mm. After removing the glass beads, the mixture was further dispersed (reduced to particles) together with zirconia ceramic beads having a diameter of about 0.6 mm in a Dino-mill (Type KDL, manufactured by Shinmaru Enterprises Corp.) at a rotation number of 2,000 rpm for 5 hours while maintaining an inner temperature at 25° C. and then further for 5 hours at 45° C. The zirconia ceramic beads were removed from the resulting dispersion liquid, then 316 g of Isopar G and 0.6 g of Charge controlling agent [CT-1] were added thereto to obtain Ink composition [DC-1S]. The solid content concentration of Ink composition [DC-1S] was 9% by weight (determined by drying on a hot plate at 145° C. for 2 hours and calculating from the change in weight).

Physical properties of Ink composition [DC-1S] were as follows.

The electric conductivity of the ink composition at 20° C. was measured under the conditions of an applied voltage 5 V and frequency of 1 kHz using LCR Meter (AG-4311, manufactured by Ando Electronic Co., Ltd.) and an electrode for liquid (Model LP-05, manufactured by Kawaguchi Electric Works Co., Ltd.) and it was found to be 100 nS/m. The charged particle exhibited positive charge.

The volume average diameter of the charged particles was measured by CAPA-700 (manufactured by Horiba, Ltd.) at a rotation number of 5,000 rpm and it was found to be 0.9 μm.

The viscosity of the ink composition at 20° C. was measured by E-type viscometer (manufactured by Tokyo Keiki Co., Ltd.) and it was found to be 1.5 mPa·sec.

Preparation of Replenishing Ink Composition [DC-1R]

Replenishing ink composition [DC-1R] was prepared in the same manner as in Preparation of Initial feeding ink composition [DC-1S] except that 316 g of Isopar G was not added after the dispersion. The solid content concentration of Replenishing ink composition [DC-1R] was 34% by weight. The ink composition had the volume average diameter of the charged particles of 0.9 μm, the electric conductivity at 20° C. of 6,500 pS/cm (650 nS/m), and the viscosity at 20° C. of 3.8 mPa·sec.

Inkjet Recording

One hundred g of Initial feeding ink composition [DC-1S] was charged in an ink tank connecting to an ejection head of an inkjet recording apparatus as shown in FIG. 1. The ejection head used was a 833-channel head of 150 dpi (three rows having a channel density of 50 dpi arranged in a stagger pattern) having a structure as shown in FIG. 2, and a fixing means used was a heat roller made of silicone rubber having a built-in 1 kW heater. An immersion heater and stirring blades were provided as an ink temperature controlling means in the ink tank, and the ink temperature was set at 30° C., which was controlled with a thermostat while rotating the stirring blades at 30 rpm. The stirring blades were also used as stirring means for preventing precipitation and aggregation. A part of the ink flow channel was made transparent, at outside of which an LED light emitting element and a photodetector element were provided, and based on the output signals therefrom, the concentration of the ink composition was controlled with a goal of solid concentration of 9% by weight by adding Replenishing ink composition [DC-1R] or a diluent for ink (Isopar G). Fine coated paper of A2 size for offset printing was used as a recording medium. After removing dusts on the surface of the recording medium by suction with an air pump, the ejection head was moved to the image forming position closely to the recording medium. Image data to be recorded were transmitted to the image data operating and controlling part, and the ink composition was ejected with sequential movement of the ejection head while the recording medium was conveyed through rotation of a conveying belt so as to form an image with a drawing resolution of 2,400 dpi. The conveying belt used was a belt prepared by laminating a metallic belt and a polyimide film, and a linear marker was provided in the conveying direction near one side of the belt. The marker was optically read out by a conveying belt position detecting means, and a position controlling means was driven to conduct the image formation. The distance between the ejection head and the recording medium was maintained at 0.5 mm based on output from an optical gap detecting device. The surface potential of the recording medium at ejection was set at −1.5 kV, and a pulse voltage of +500 V (with a pulse width of 50 μsec) was applied at ejection to conduct the image recording with a driving frequency of 10 kHz.

Immediately after the image recording, the image was fixed by means of a heat roller. Specifically, temperature of the coated paper at the fixing was 90° C. and contact time of the coated paper with the heat roller was 0.3 seconds.

The image recording was conducted on 100 sheets of the coated paper and the ink was ejected so that the image could be recorded on all sheets. Density of a solid portion on each of the first sheet and the 100th sheet was measured. The results obtained are shown in Table 1 below. As is apparent from the results shown in Table 1, difference in the image density is hardly observed between the first sheet and the 100th sheet and stable ejection property is confirmed. The image density is a value measured by X-Rite 508 optical densitometer (manufactured by X-Rite Inc.)

COMPARATIVE EXAMPLE 1

The inkjet image recording was conducted in the same manner as in Example 1 except that Replenishing ink composition [DC-1R] was not used as the replenishing ink composition. The results obtained are shown in Table 1 below. As is apparent from the results shown in Table 1, the ink is not ejected on a 100th sheet.

COMPARATIVE EXAMPLE 2

The inkjet image recording was conducted in the same manner as in Example 1 except that Initial feeding ink composition [DC-1S] was used as the replenishing ink composition. The results obtained are shown in Table 1 below. As is apparent from the results shown in Table 1, the image density on the 100th sheet is considerably decreased in comparison with that of the first sheet.

TABLE 1

| | Example 1 | Comparative Example 1 | Comparative Example 2 |
|---|---|---|---|
| Initial Feeding Ink Composition | [DC-1S] | [DC-1S] | [DC-1S] |
| Replenishing Ink Composition | [DC-1R] | None | [DC-1S] |
| Solid Image Density of First Sheet | 1.59 | 1.59 | 1.59 |
| Solid Image Density of 100th Sheet | 1.56 | No ejection of ink | 1.22 |

EXAMPLE 2

Initial feeding ink composition [DM-1S] and Replenishing ink composition [DM-1R] were prepared in the same manner as in Example 1 except that a magenta pigment, C.I. Pigment Red 57:1 (Brilliant Carmine 6B (trade name: L. R. FG-4213), manufactured by Toyo Ink Mfg. Co., Ltd.) was used in place of the cyan dye employed in the preparations of Initial feeding ink composition [DC-1S] and Replenishing ink composition [DC-1R] in Example 1. Physical properties of the ink compositions thus obtained are shown in Table 2 below. The inkjet image recording was conducted in the same manner as in Example 1 using the ink compositions thus obtained. The results obtained are shown in Table 3 below. As is apparent from the results shown in Table 3, difference in the image density is hardly observed between the first sheet and the 100th sheet and stable ejection property is confirmed.

COMPARATIVE EXAMPLE 3

The inkjet image recording was conducted in the same manner as in Example 2 except that Replenishing ink composition [DM-1R] was not used as the replenishing ink composition. The results obtained are shown in Table 3 below. As is apparent from the results shown in Table 3, the ink is not ejected on a 100th sheet.

COMPARATIVE EXAMPLE 4

The inkjet image recording was conducted in the same manner as in Example 2 except that Initial feeding ink composition [DM-1S] was used as the replenishing ink composition. The results obtained are shown in Table 3 below. As is apparent from the results shown in Table 3, the image density on the 100th sheet is considerably decreased in comparison with that of the first sheet.

TABLE 2

| | [DM-1S] | [DM-1R] |
|---|---|---|
| Volume Average Diameter of Charged Particles | 0.7 μm | 0.7 μm |
| Solid Content Concentration | 9% by weight | 34% by weight |
| Electric Conductivity | 1,100 pS/cm (110 nS/m) | 7,300 pS/cm (730 nS/m) |

TABLE 3

| | Example 2 | Comparative Example 3 | Comparative Example 4 |
|---|---|---|---|
| Initial Feeding Ink Composition | [DM-1S] | [DM-1S] | [DM-1S] |
| Replenishing Ink Composition | [DM-1R] | None | [DM-1S] |
| Solid Image Density of First Sheet | 1.55 | 1.55 | 1.55 |
| Solid Image Density of 100th Sheet | 1.51 | No ejection of ink | 1.23 |

EXAMPLE 3

Initial feeding ink composition [DY-1S] and Replenishing ink composition [DY-1R] were prepared in the same manner as in Example 1 except that a yellow pigment composed of a mixture of C.I. Pigment Yellow 180 (Toner Yellow HG, manufactured by Clariant Ltd.) and C.I. Pigment Yellow 139 (Novoperm Yellow M2R 70, manufactured by Clariant Ltd.) in a weight ratio of 1:1 was used in place of the cyan dye employed in the preparations of Initial feeding ink composition [DC-1S] and Replenishing ink composition [DC-1R] in Example 1. Physical properties of the ink compositions thus obtained are shown in Table 4 below. The inkjet image recording was conducted in the same manner as in Example 1 using the ink compositions thus obtained. The results obtained are shown in Table 5 below. As is apparent from the results shown in Table 5, difference in the image density is hardly observed between the first sheet and the 100th sheet and stable ejection property is confirmed.

COMPARATIVE EXAMPLE 5

The inkjet image recording was conducted in the same manner as in Example 3 except that Replenishing ink composition [DY-1R] was not used as the replenishing ink composition. The results obtained are shown in Table 5 below. As is apparent from the results shown in Table 5, the ink is not ejected on a 100th sheet.

COMPARATIVE EXAMPLE 6

The inkjet image recording was conducted in the same manner as in Example 3 except that Initial feeding ink composition [DY-1S] was used as the replenishing ink composition. The results obtained are shown in Table 5 below. As is apparent from the results shown in Table 5, the image density on the 100th sheet is considerably decreased in comparison with that of the first sheet.

TABLE 4

| | [DY-1S] | [DY-1R] |
|---|---|---|
| Volume Average Diameter of Charged Particles | 1.1 μm | 1.1 μm |
| Solid Content Concentration | 9% by weight | 34% by weight |
| Electric Conductivity | 1,300 pS/cm (130 nS/m) | 5,600 pS/cm (560 nS/m) |

TABLE 5

| | Example 3 | Comparative Example 5 | Comparative Example 6 |
|---|---|---|---|
| Initial Feeding Ink Composition | [DY-1S] | [DY-1S] | [DY-1S] |
| Replenishing Ink Composition | [DY-1R] | None | [DY-1S] |
| Solid Image Density of First Sheet | 0.97 | 0.97 | 0.97 |
| Solid Image Density of 100th Sheet | 0.93 | No ejection of ink | 0.79 |

EXAMPLE 4

Initial feeding ink composition [DK-1S] and Replenishing ink composition [DK-1R] were prepared in the same manner as in Example 1 except that a black pigment, C.I. Pigment Black 7 (Carbon Black MA-100 manufactured by Mitsubishi Chemical Corp.) was used in place of the cyan dye employed in the preparations of Initial feeding ink composition [DC-1S] and Replenishing ink composition [DC-1R] in Example 1. Physical properties of the ink compositions thus obtained are shown in Table 6 below. The inkjet image recording was conducted in the same manner as in Example 1 using the ink compositions thus obtained. The results obtained are shown in Table 7 below. As is apparent from the results shown in Table 7, difference in the image density is hardly observed between the first sheet and the 100th sheet and stable ejection property is confirmed.

COMPARATIVE EXAMPLE 7

The inkjet image recording was conducted in the same manner as in Example 4 except that Replenishing ink composition [DK-1R] was not used as the replenishing ink composition. The results obtained are shown in Table 7 below. As is apparent from the results shown in Table 7, the ink is not ejected on a 100th sheet.

COMPARATIVE EXAMPLE 8

The inkjet image recording was conducted in the same manner as in Example 4 except that Initial feeding ink composition [DK-1S] was used as the replenishing ink composition. The results obtained are shown in Table 7 below. As is apparent from the results shown in Table 7, the image density on the 100th sheet is considerably decreased in comparison with that of the first sheet.

TABLE 6

| | [DK-1S] | [DK-1R] |
|---|---|---|
| Volume Average Diameter of Charged Particles | 1.2 μm | 1.2 μm |
| Solid Content Concentration | 9% by weight | 34% by weight |
| Electric Conductivity | 900 pS/cm (90 nS/m) | 4,800 pS/cm (480 nS/m) |

TABLE 7

| | Example 4 | Comparative Example 7 | Comparative Example 8 |
|---|---|---|---|
| Initial Feeding Ink Composition | [DK-1S] | [DK-1S] | [DK-1S] |
| Replenishing Ink Composition | [DK-1R] | None | [DK-1S] |
| Solid Image Density of First Sheet | 1.79 | 1.79 | 1.79 |
| Solid Image Density of 100th Sheet | 1.73 | No ejection of ink | 1.38 |

EXAMPLE 5

Preparation of Initial Feeding Ink Composition [EC-1S]

In a desktop kneader (PBV-0.1, manufactured by Irie Shokai Co., Ltd.) were charged 10 g of the cyan pigment same as that used in Example 1 and 20 g of Coating agent [AP-1], and the components were mixed under heating at a heater temperature set at 100° C. for 2 hours. Thirty grams of the mixture thus obtained was coarsely pulverized in a trio blender (manufactured by Trio Science Co., Ltd.), and then finely pulverized in a sample mill (Model SK-M10, manufactured by Kyoritsu Riko Co., Ltd.). Thirty grams of the finely pulverized product thus obtained was preliminary dispersed in a paint shaker (manufactured by Toyo Seiki Seisaki-Sho, Ltd.) together with 7.5 g of Dispersing agent (BZ-2), 75 g of Isopar G and glass beads having a diameter of about 3.0 mm. After removing the glass beads, the mixture was further dispersed (reduced to particles) together with zirconia ceramic beads having a diameter of about 0.6 mm in a Dino-mill (Type KDL, manufactured by Shinmaru Enterprises Corp.) at a rotation number of 2,000 rpm for 5 hours while maintaining an inner temperature at 25° C. and then further for 5 hours at 45° C. The zirconia ceramic beads were removed from the resulting dispersion liquid, then 316 g of Isopar G and 0.6 g of Charge controlling agent [CT-1] were added thereto to obtain Ink composition [EC-1S]. The solid content concentration of Ink composition [EC-1S] was 9% by weight.

Physical properties of Ink composition [EC-1S] were as follows.

The electric conductivity of the ink composition at 20° C. was measured under the conditions of an applied voltage 5 V and frequency of 1 kHz using LCR Meter (AG-4311, manufactured by Ando Electronic Co., Ltd.) and an electrode for liquid (Model LP-05, manufactured by Kawaguchi Electric Works Co., Ltd.) and it was found to be 100 nS/m. The charged particle exhibited positive charge.

The volume average diameter of the charged particles was measured by CAPA-700 (manufactured by Horiba, Ltd.) at a rotation number of 5,000 rpm and it was found to be 0.9 μm.

The viscosity of the ink composition at 20° C. was measured by E-type viscometer (manufactured by Tokyo Keiki Co., Ltd.) and it was found to be 1.5 mPa·sec.

Preparation of Replenishing Ink Composition [EC-1R]>

In a desktop kneader (PBV-0.1, manufactured by Irie Shokai Co., Ltd.) were charged 10 g of the cyan pigment same as that described above and 20 g of Coating agent [AP-1], and the components were mixed under heating at a heater temperature set at 100° C. for 2 hours. Thirty grams of the mixture thus obtained was coarsely pulverized in a trio blender (manufactured by Trio Science Co., Ltd.), and then finely pulverized in a sample mill (Model SK-M10, manufactured by Kyoritsu Riko Co., Ltd.). Thirty grams of the finely pulverized product thus obtained was preliminary dispersed in a paint shaker (manufactured by Toyo Seiki Seisaki-Sho, Ltd.) together with 3.5 g of Dispersing agent (BZ-2), 75 g of Isopar G and glass beads having a diameter of about 3.0 mm. After removing the glass beads, the mixture was further dispersed (reduced to particles) together with zirconia ceramic beads having a diameter of about 0.6 mm in a Dino-mill (Type KDL, manufactured by Shinmaru Enterprises Corp.) at a rotation number of 2,000 rpm for 4 hours while maintaining an inner temperature at 30° C. and then further for 5 hours at 45° C. The zirconia ceramic beads were removed from the resulting dispersion liquid, then 0.6 g of Charge controlling agent [CT-1] was added thereto to obtain Ink composition [EC-1R]. The volume average diameter of the charged particles in Ink composition [EC-1R] was 1.3 μm. The electric conductivity of the ink composition at 20° C. was 5,100 pS/cm (510 nS/m), the viscosity thereof at 20° C. was 3.5 mPa·sec, and the solid content concentration thereof was 31% by weight.

Inkjet Recording

One hundred g of Initial feeding ink composition [EC-1S] was charged in an ink tank connecting to an ejection head of an inkjet recording apparatus as shown in FIG. 1. The ejection head used was a 833-channel head of 150 dpi (three rows having a channel density of 50 dpi arranged in a stagger pattern) having a structure as shown in FIG. 2, and a fixing means used was a heat roller made of silicone rubber having a built-in 1 kW heater. An immersion heater and stirring blades were provided as an ink temperature controlling means in the ink tank, and the ink temperature was set at 30° C., which was controlled with a thermostat while rotating the stirring blades at 30 rpm. The stirring blades were also used as stirring means for preventing precipitation and aggregation. A part of the ink flow channel was made transparent, at outside of which an LED light emitting element and a photodetector element were provided, and based on the output signals therefrom, the concentration of the ink composition was controlled with a goal of solid concentration of 9% by weight by adding Replenishing ink composition [EC-1R] or a diluent for ink (Isopar G). Fine coated paper of A2 size for offset printing was used as a recording medium. After removing dusts on the surface of the recording medium by suction with an air pump, the ejection head was moved to the image forming position closely to the recording medium. Image data to be recorded were transmitted to the image data operating and controlling part, and the ink composition was ejected with sequential movement of the ejection head while the recording medium was conveyed through rotation of a conveying belt so as to form an image with a drawing resolution of 2,400 dpi. The conveying belt used was a belt prepared by laminating a metallic belt and a polyimide film, and a linear marker was provided in the conveying direction near one side of the belt. The marker was optically read out by a conveying belt position detecting means, and a position controlling means was driven to conduct the image formation. The distance between the ejection head and the recording medium was maintained at 0.5 mm based on output from an optical gap detecting device. The surface potential of the recording medium at ejection was set at −1.5 kV, and a pulse voltage of +500 V (with a pulse width of 50 μsec) was applied at ejection to conduct the image recording while changing a driving frequency in a range of from 1 to 15 kHz.

Immediately after the image recording, the image was fixed by means of a heat roller. Specifically, temperature of the coated paper at the fixing was 90° C. and contact time of the coated paper with the heat roller was 0.3 seconds.

The image recording was conducted on 400 sheets of the coated paper, and a frequency at which image dot could be formed in response to the driving pulse was determined on each of the first sheet and 400th sheet by an optical microscope and referred to as a following frequency. Also, density of a solid portion on each of the first sheet and the 400th sheet was measured. The results obtained are shown in Table 8 below. As is apparent from the results shown in Table 8, differences in the following frequency and image density are hardly observed between the first sheet and the 400th sheet and stable ejection property is confirmed. The image density is a value measured by X-Rite 508 optical densitometer (manufactured by X-Rite Inc.)

COMPARATIVE EXAMPLE 9

The inkjet image recording was conducted in the same manner as in Example 5 except that Initial feeding ink composition [EC-1S] was used as the replenishing ink composition. The results obtained are shown in Table 8 below. As is apparent from the results shown in Table 8, the following frequency and image density on the 400th sheet are considerably decreased in comparison with those of the first sheet. The decrease in the following frequency undesirably results in the decrease in the recording speed.

TABLE 8

| | Example 5 | Comparative Example 9 |
|---|---|---|
| Initial Feeding Ink Composition | [EC-1S] | [EC-1S] |
| Replenishing Ink Composition | [EC-1R] | [EC-1S] |
| Following Frequency of First Sheet | 15 kHz | 15 kHz |
| Following Frequency of 400th Sheet | 15 kHz | 1 kHz |

TABLE 8-continued

| | Example 5 | Comparative Example 9 |
|---|---|---|
| Solid Image Density of First Sheet | 1.59 | 1.59 |
| Solid Image Density of 400th Sheet | 1.58 | 0.27 |

EXAMPLE 6

Initial feeding ink composition [EM-1S] and Replenishing ink composition [EM-1R] were prepared in the same manner as in Example 5 except that a magenta pigment, C.I. Pigment Red 57:1 (Brilliant Carmine 6B (trade name: L. R. FG-4213), manufactured by Toyo Ink Mfg. Co., Ltd.) was used in place of the cyan dye employed in the preparations of Initial feeding ink composition [EC-1S] and Replenishing ink composition [EC-1R] in Example 5. Physical properties of the ink compositions thus obtained are shown in Table 9 below. The inkjet image recording was conducted in the same manner as in Example 5 using the ink compositions thus obtained. The results obtained are shown in Table 10 below. As is apparent from the results shown in Table 10, differences in the following frequency and image density are hardly observed between the first sheet and the 400th sheet and stable ejection property is confirmed.

COMPARATIVE EXAMPLE 10

The inkjet image recording was conducted in the same manner as in Example 6 except that Initial feeding ink composition [EM-1S] was used as the replenishing ink composition. The results obtained are shown in Table 10 below. As is apparent from the results shown in Table 10, the following frequency and image density on the 400th sheet are considerably decreased in comparison with those of the first sheet.

TABLE 9

| | [EM-1S] | [EM-1R] |
|---|---|---|
| Volume Average Diameter of Charged Particles | 0.7 μm | 1.1 μm |
| Solid Content Concentration | 9% by weight | 31% by weight |
| Electric Conductivity | 1,100 pS/cm (110 nS/m) | 5,800 pS/cm (580 nS/m) |

TABLE 10

| | Example 6 | Comparative Example 10 |
|---|---|---|
| Initial Feeding Ink Composition | [EM-1S] | [EM-1S] |
| Replenishing Ink Composition | [EM-1R] | [EM-1S] |
| Following Frequency of First Sheet | 15 kHz | 15 kHz |

TABLE 10-continued

| | Example 6 | Comparative Example 10 |
|---|---|---|
| Following Frequency of 400th Sheet | 15 kHz | 1 kHz |
| Solid Image Density of First Sheet | 1.55 | 1.55 |
| Solid Image Density of 400th Sheet | 1.55 | 0.19 |

EXAMPLE 7

Initial feeding ink composition [EY-1S] and Replenishing ink composition [EY-1R] were prepared in the same manner as in Example 5 except that a yellow pigment composed of a mixture of C.I. Pigment Yellow 180 (Toner Yellow HG, manufactured by Clariant Ltd.) and C.I. Pigment Yellow 139 (Novoperm Yellow M2R 70, manufactured by Clariant Ltd.) in a weight ratio of 1:1 was used in place of the cyan dye employed in the preparations of Initial feeding ink composition [EC-1S] and Replenishing ink composition [EC-1R] in Example 5. Physical properties of the ink compositions thus obtained are shown in Table 11 below. The inkjet image recording was conducted in the same manner as in Example 5 using the ink compositions thus obtained. The results obtained are shown in Table 12 below. As is apparent from the results shown in Table 12, differences in the following frequency and image density are hardly observed between the first sheet and the 400th sheet and stable ejection property is confirmed.

COMPARATIVE EXAMPLE 11

The inkjet image recording was conducted in the same manner as in Example 7 except that Initial feeding ink composition [EY-1S] was used as the replenishing ink composition. The results obtained are shown in Table 12 below. As is apparent from the results shown in Table 12, the following frequency and image density on the 400th sheet are considerably decreased in comparison with those of the first sheet.

TABLE 11

| | [EY-1S] | [EY-1R] |
|---|---|---|
| Volume Average Diameter of Charged Particles | 1.1 μm | 1.6 μm |
| Solid Content Concentration | 9% by weight | 31% by weight |
| Electric Conductivity | 1,300 pS/cm (130 nS/m) | 4,100 pS/cm (410 nS/m) |

TABLE 12

| | Example 7 | Comparative Example 11 |
|---|---|---|
| Initial Feeding Ink Composition | [EY-1S] | [EY-1S] |
| Replenishing Ink Composition | [EY-1R] | [EY-1S] |
| Following Frequency of First Sheet | 15 kHz | 15 kHz |

TABLE 12-continued

| | Example 7 | Comparative Example 11 |
|---|---|---|
| Following Frequency of 400th Sheet | 15 kHz | 1 kHz |
| Solid Image Density of First Sheet | 0.97 | 0.97 |
| Solid Image Density of 400th Sheet | 0.99 | 0.25 |

EXAMPLE 8

Initial feeding ink composition [EK-1S] and Replenishing ink composition [EK-1R] were prepared in the same manner as in Example 5 except that a black pigment, C.I. Pigment Black 7 (Carbon Black MA-100 manufactured by Mitsubishi Chemical Corp.) was used in place of the cyan dye employed in the preparations of Initial feeding ink composition [EC-1S] and Replenishing ink composition [EC-1R] in Example 5. Physical properties of the ink compositions thus obtained are shown in Table 13 below. The inkjet image recording was conducted in the same manner as in Example 5 using the ink compositions thus obtained. The results obtained are shown in Table 14 below. As is apparent from the results shown in Table 14, differences in the following frequency and image density are hardly observed between the first sheet and the 400th sheet and stable ejection property is confirmed.

COMPARATIVE EXAMPLE 12

The inkjet image recording was conducted in the same manner as in Example 8 except that Initial feeding ink composition [EK-1S] was used as the replenishing ink composition. The results obtained are shown in Table 14 below. As is apparent from the results shown in Table 14, the following frequency and image density on the 400th sheet are considerably decreased in comparison with those of the first sheet.

TABLE 13

| | [EK-1S] | [EK-1R] |
|---|---|---|
| Volume Average Diameter of Charged Particles | 1.2 μm | 1.4 μm |
| Solid Content Concentration | 9% by weight | 31% by weight |
| Electric Conductivity | 900 pS/cm (90 nS/m) | 4,300 pS/cm (430 nS/m) |

TABLE 14

| | Example 8 | Comparative Example 12 |
|---|---|---|
| Initial Feeding Ink Composition | [EK-1S] | [EK-1S] |
| Replenishing Ink Composition | [EK-1R] | [EK-1S] |

TABLE 14-continued

| | Example 8 | Comparative Example 12 |
|---|---|---|
| Following Frequency of First Sheet | 15 kHz | 15 kHz |
| Following Frequency of 400th Sheet | 15 kHz | 1 kHz |
| Solid Image Density of First Sheet | 1.79 | 1.79 |
| Solid Image Density of 400th Sheet | 1.77 | 0.16 |

The entire disclosure of each and every foreign patent application from which the benefit of foreign priority has been claimed in the present application is incorporated herein by reference, as if fully set forth herein.

While the invention has been described in detail and with reference to specific embodiments thereof, it will be apparent to one skilled in the art that various changes and modifications can be made therein without departing from the spirit and scope thereof.

What is claimed is:

1. An inkjet recording method comprising ejecting an ink composition comprising a dispersion medium and charged particles containing at least a colorant by utilizing an electrostatic field, wherein the method comprises preparing as the ink composition, an initial feeding ink composition and a replenishing ink composition in which a volume average particle diameter of the charged particles is controlled larger than a volume average particle diameter of the charged particles in the initial feeding ink composition, and replenishing the replenishing ink composition in order to compensate decrease in concentration of the charged particles due to ejection of the initial feeding ink composition.

2. An inkjet recording method as claimed in claim 1, wherein the solid content concentration of the replenishing ink composition is controlled higher than the solid content concentration of the initial feeding ink composition.

3. The inkjet recording method as claimed in claim 1, wherein the volume average particle diameter (DS) of the charged particles of the initial feeding ink composition is adjusted from 0.20 to 4.5 μm, the volume average particle diameter (DR) of the charged particles of the replenishing ink composition is adjusted from 0.21 to 5.0 μm, and a relation between DS and DR is adjusted from 1.05 to 4.0 in terms of a ratio of DR/DS.

4. The inkjet recording method as claimed in claim 3, wherein the solid content concentration of the initial feeding ink composition is adjusted from 1 to 40% by weight, the solid content concentration of the replenishing ink composition is adjusted from 2 to 60% by weight, and a ratio of the solid content concentration between the initial feeding ink composition and the replenishing ink composition is adjusted from 1.05 to 10.0 in terms of a ratio of the latter/the former.

* * * * *